US010714248B2

(12) United States Patent
Yoshida et al.

(10) Patent No.: US 10,714,248 B2
(45) Date of Patent: Jul. 14, 2020

(54) REACTOR HAVING OUTER PERIPHERAL IRON CORE DIVIDED INTO MULTIPLE PORTIONS AND PRODUCTION METHOD THEREFOR

(71) Applicant: FANUC CORPORATION, Yamanashi (JP)

(72) Inventors: Tomokazu Yoshida, Yamanashi (JP); Masatomo Shirouzu, Yamanashi (JP); Kenichi Tsukada, Yamanashi (JP)

(73) Assignee: FANUC CORPORATION, Yamanashi (JP)

( * ) Notice: Subject to any disclaimer, the term of this patent is extended or adjusted under 35 U.S.C. 154(b) by 21 days.

(21) Appl. No.: 15/985,036

(22) Filed: May 21, 2018

(65) Prior Publication Data

US 2018/0336984 A1 Nov. 22, 2018

(30) Foreign Application Priority Data

May 22, 2017 (JP) ..... 2017-100867

(51) Int. Cl.

| | |
|---|---|
| ***H01F 30/12*** | (2006.01) |
| ***H01F 3/14*** | (2006.01) |
| ***H01F 27/30*** | (2006.01) |
| ***H01F 27/26*** | (2006.01) |
| ***H01F 27/38*** | (2006.01) |
| ***H01F 37/00*** | (2006.01) |

(52) U.S. Cl.

CPC ..... *H01F 3/14* (2013.01); *H01F 27/263* (2013.01); *H01F 27/306* (2013.01); *H01F 27/38* (2013.01); *H01F 37/00* (2013.01)

(58) Field of Classification Search

CPC ..... H01F 27/263; H01F 27/306
USPC ..... 336/210
See application file for complete search history.

(56) References Cited

U.S. PATENT DOCUMENTS

| | | | | |
|---|---|---|---|---|
| 3,891,954 | A * | 6/1975 | Konishi | H01F 27/263 336/61 |
| 4,912,618 | A | 3/1990 | Krinickas, Jr. | |
| 8,013,703 | B2 | 9/2011 | Hashino et al. | |
| 9,899,135 | B2 | 2/2018 | Nakanoue et al. | |
| 10,008,322 | B2 | 6/2018 | Bhide et al. | |
| 2009/0261939 | A1* | 10/2009 | Shudarek | H01F 3/10 336/212 |
| 2012/0106210 | A1 | 5/2012 | Xu et al. | |
| 2013/0187741 | A1* | 7/2013 | Goodrich | H01F 3/10 336/170 |
| 2015/0179330 | A1 | 6/2015 | Nakanoue et al. | |

(Continued)

FOREIGN PATENT DOCUMENTS

| | | |
|---|---|---|
| CN | 201765902 U | 3/2011 |
| CN | 104471657 A | 3/2015 |

(Continued)

*Primary Examiner* — Ronald Hinson
(74) *Attorney, Agent, or Firm* — RatnerPrestia

(57) ABSTRACT

A reactor includes a core body. The core body includes an outer peripheral iron core composed of a plurality of outer peripheral iron core portions, at least three iron cores coupled to the plurality of outer peripheral iron core portions, and coils wound around the at least three iron cores. The reactor includes an end plate fastened to at least one end of the core body. The end plate includes a plurality of fasteners for fastening the plurality of outer peripheral iron core portions to each other.

7 Claims, 8 Drawing Sheets

(56) References Cited

U.S. PATENT DOCUMENTS

| | | | | |
|---|---|---|---|---|
| 2016/0352176 | A1 | 12/2016 | Tokizaki et al. | |
| 2017/0011842 | A1 | 1/2017 | Ishigaki et al. | |
| 2017/0040099 | A1* | 2/2017 | Bhide | H01F 27/245 |
| 2017/0084377 | A1 | 3/2017 | Maeda et al. | |
| 2018/0268991 | A1 | 9/2018 | Tsukada et al. | |

FOREIGN PATENT DOCUMENTS

| | | | |
|---|---|---|---|
| CN | 106063083 | A | 10/2016 |
| DE | 1513862 | A1 | 4/1969 |
| DE | 102016010901 | A1 | 3/2017 |
| DE | 102018109372 | A1 | 10/2018 |
| JP | S42019152 | Y | 11/1967 |
| JP | S49043123 | A | 4/1974 |
| JP | H03502279 | A | 5/1991 |
| JP | 2000-077242 | A | 3/2000 |
| JP | 2008177325 | A | 7/2008 |
| JP | 2008177500 | A | 7/2008 |
| JP | 2008182053 | A | 8/2008 |
| JP | 2008-210998 | A | 9/2008 |
| JP | 2009170620 | A | 7/2009 |
| JP | 2009194957 | A | 8/2009 |
| JP | 2010252539 | A | 11/2010 |
| JP | 2013026418 | A | 2/2013 |
| JP | 2015159657 | A | 9/2015 |
| JP | 2016122830 | A | 7/2016 |
| JP | 2014073252 | A1 | 9/2016 |
| JP | 2017059805 | A | 3/2017 |
| JP | 6378385 | B1 | 8/2018 |
| WO | 2010119324 | A2 | 10/2010 |
| WO | 2015142354 | A1 | 9/2015 |

* cited by examiner

REACTOR HAVING OUTER PERIPHERAL IRON CORE DIVIDED INTO MULTIPLE PORTIONS AND PRODUCTION METHOD THEREFOR

CROSS-REFERENCE TO RELATED APPLICATION

This application is a new U.S. Patent Application that claims benefit of Japanese Patent Application No. 2017-100867, filed May 22, 2017, the disclosure of this application is being incorporated herein by reference in its entirety for all purposes.

BACKGROUND OF THE INVENTION

1. Field of the Invention

The present invention relates to a reactor having an outer peripheral iron core which is divided into a plurality of portions, and a production method therefor.

2. Description of Related Art

Reactors include a plurality of iron core coils, and each iron core coil includes an iron core and a coil wound around the iron core. Predetermined gaps are formed between the plurality of iron cores. Refer to, for example, Japanese Unexamined Patent Publication (Kokai) No. 2000-77242 and Japanese Unexamined Patent Publication (Kokai) No. 2008-210998.

SUMMARY OF THE INVENTION

There are also reactors in which a plurality of iron core coils are arranged inside an outer peripheral iron core composed of a plurality of outer peripheral iron core portions. In such reactors, each iron core is integrally formed with the respective outer peripheral iron core portion.

In this case, the dimensions of the aforementioned gaps vary in accordance with the combination accuracy of the outer peripheral iron core portions. When the outer peripheral iron core portions are misaligned and combined, gaps of a desired dimension cannot be obtained, and as a result, there is a problem that an expected inductance cannot be guaranteed. Further, special jigs are sometimes required to obtain gaps of the desired dimensions.

Therefore, a reactor that can easily obtain gaps of desired dimensions without the use of special jigs is desired.

The first aspect of the present disclosure provides a reactor comprising a core body, the core body comprising an outer peripheral iron core composed of a plurality of outer peripheral iron core portions, at least three iron cores coupled to the plurality of outer peripheral iron core portions, and coils wound around the at least three iron cores. The reactor further comprises an end plate fastened to at least one end of the core body, wherein the end plate includes a plurality of fasteners for fastening the plurality of outer peripheral iron core portions to each other.

In the first aspect, since the plurality of fasteners fasten the plurality of outer peripheral iron core portions to each other, it is easy to maintain the desired dimensions of the gaps formed between two adjacent iron cores from among the at least three iron cores. Further, a lack of need for special jigs at the time of production can dramatically increase assembly efficiency.

The object, features, and advantages of the present disclosure, as well as other objects, features and advantages, will be further clarified by the detailed description of the representative embodiments of the present disclosure shown in the accompanying drawings.

DETAILED DESCRIPTION

Figure 1:
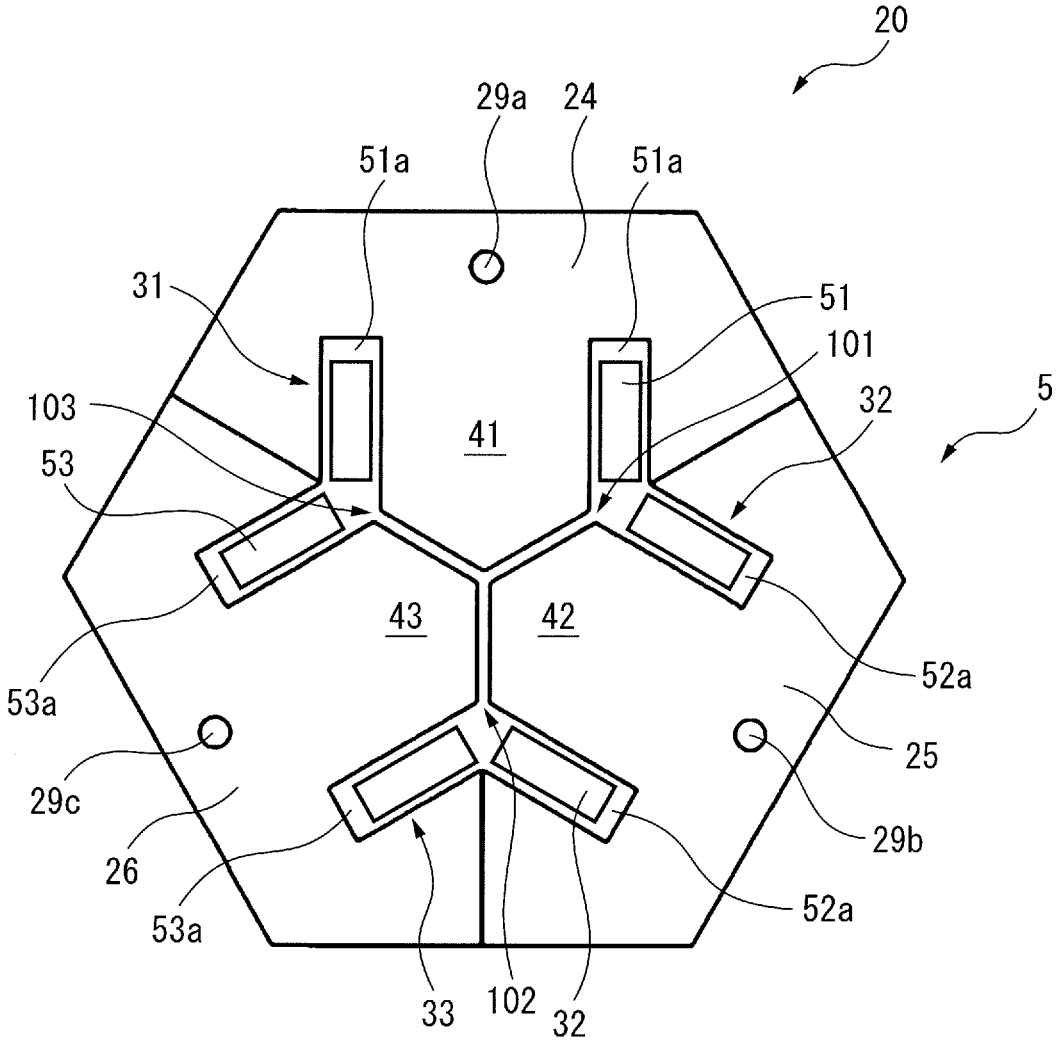
FIG. 1 is a cross-sectional view of a core body of a reactor of a first embodiment.

The embodiments of the present disclosure will be described below with reference to the accompanying drawings. In the following drawings, the same components are given the same reference numerals. For ease of understanding, the scales of the drawings have been appropriately modified.

In the following description, a three-phase reactor will be described as an example. However, the present disclosure is not limited in application to a three-phase reactor, but can be broadly applied to any multiphase reactor requiring constant inductance in each phase. Further, the reactor according to the present disclosure is not limited to those provided on the primary side or secondary side of the inverters of industrial robots or machine tools, but can be applied to various machines.

FIG. 1 is a cross-sectional view of the core body of the reactor of the first embodiment. As shown in FIG. 1, the core body 5 of the reactor 6 includes an outer peripheral iron core 20, and three iron core coils 31 to 33 which are magnetically connected to the outer peripheral iron core 20. In FIG. 1, the iron core coils 31 to 33 are disposed inside the substantially hexagonal outer peripheral iron core 20. These iron core coils 31 to 33 are arranged at equal intervals in the circumferential direction of the core body 5.

Note that the outer peripheral iron core 20 may have another rotationally symmetrical shape, such as a circular shape. In such a case, the end plate 81, which is described later, has a shape corresponding to that of the outer peripheral iron core 20. Furthermore, the number of iron core coils may be a multiple of three, whereby the reactor 6 can be used as a three-phase reactor.

As can be understood from the drawings, the iron core coils 31 to 33 include iron cores 41 to 43, which extend in the radial directions of the outer peripheral iron core 20, and coils 51 to 53, which are wound around the iron cores, respectively. The outer peripheral iron core 20 and the iron cores 41 to 43 are formed by stacking a plurality of iron plates, carbon steel plates, or electromagnetic steel sheets, or are formed from a powder iron core.

The outer peripheral iron core 20 is composed of a plurality of, for example, three outer peripheral iron core portions 24 to 26 divided in the circumferential direction. The outer peripheral iron core portions 24 to 26 are formed integrally with the iron cores 41 to 43, respectively. When the outer peripheral iron core 20 is formed from a plurality of outer peripheral iron core portions 24 to 26, even if the outer peripheral iron core 20 is large, such a large outer peripheral iron core 20 can be easily manufactured. Note that the number of iron cores 41 to 43 and the number of outer peripheral iron core portions 24 to 26 need not necessarily be the same.

The coils 51 to 53 are arranged in coil spaces 51*a* to 53*a* formed between the outer peripheral iron core portions 24 to 26 and the iron cores 41 to 43, respectively. In the coil spaces 51*a* to 53*a*, the inner peripheral surfaces and the outer peripheral surfaces of the coils 51 to 53 are adjacent to the inner wall of the coil spaces 51*a* to 53*a*.

Further, the radially inner ends of the iron cores 41 to 43 are each located near the center of the outer peripheral iron core 20. In the drawings, the radially inner ends of the iron cores 41 to 43 converge toward the center of the outer peripheral iron core 20, and the tip angles thereof are approximately 120 degrees. The radially inner ends of the iron cores 41 to 43 are separated from each other via gaps 101 to 103, which can be magnetically coupled.

In other words, the radially inner end of the iron core 41 is separated from the radially inner ends of the two adjacent iron cores 42 and 43 via gaps 101 and 103. The same is true for the other iron cores 42 and 43. Note that, the sizes of the gaps 101 to 103 are equal to each other.

In the configuration shown in FIG. 1, since a central iron core disposed at the center of the core body 5 is not needed, the core body 5 can be constructed lightly and simply. Further, since the three iron core coils 31 to 33 are surrounded by the outer peripheral iron core 20, the magnetic fields generated by the coils 51 to 53 do not leak to the outside of the outer peripheral core 20. Furthermore, since the gaps 101 to 103 can be provided at any thickness at a low cost, the configuration shown in FIG. 1 is advantageous in terms of design, as compared to conventionally configured reactors.

Further, in the core body 5 of the present disclosure, the difference in the magnetic path lengths is reduced between the phases, as compared to conventionally configured reactors. Thus, in the present disclosure, the imbalance in inductance due to a difference in magnetic path length can be reduced.

Figure 2:
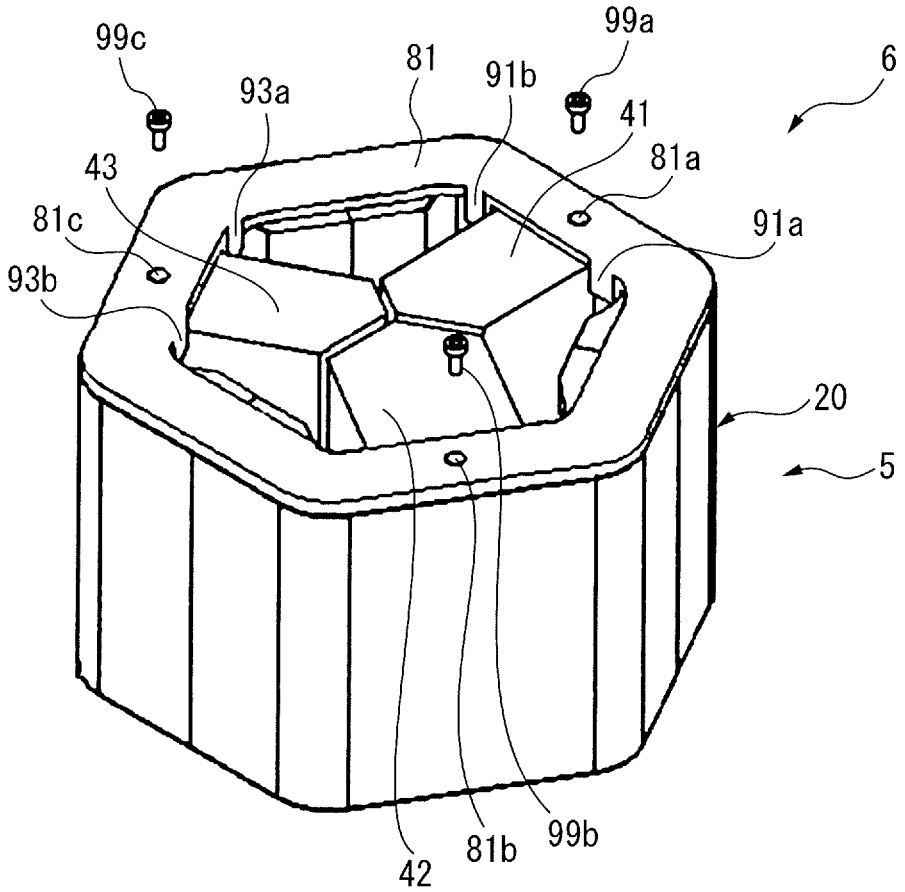
FIG. 2 is a perspective view of the reactor based on the first embodiment.
Figure 8:
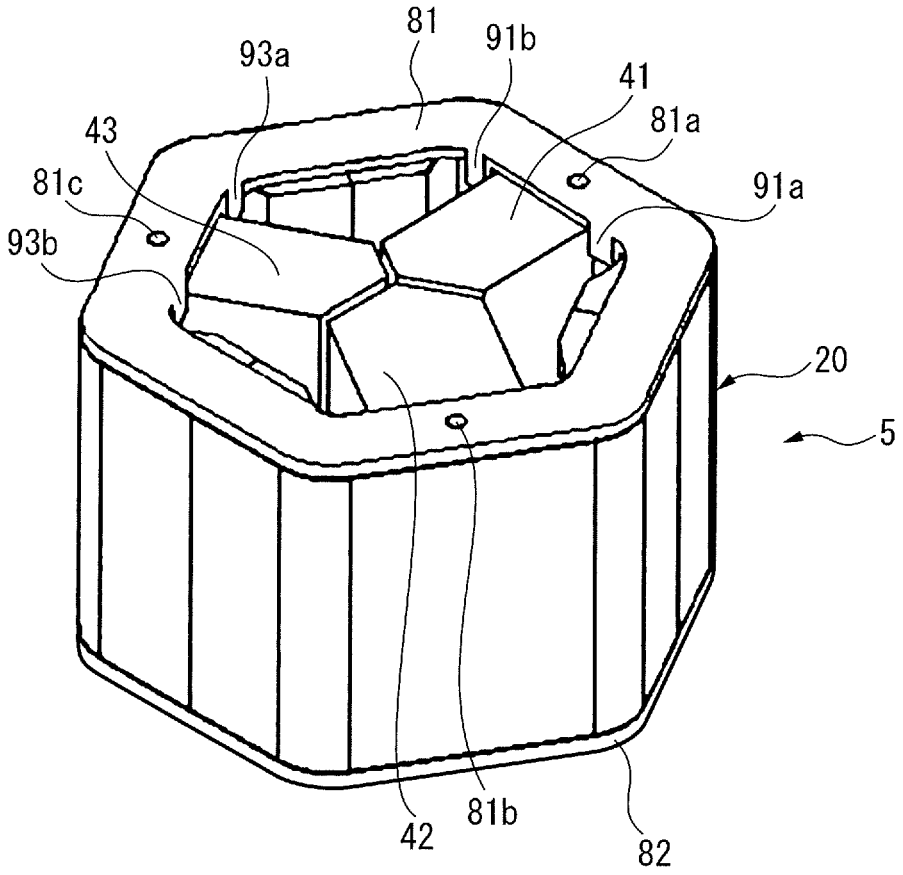
FIG. 8 is a perspective view of a reactor based on a third embodiment.

FIG. 2 is a perspective view of a reactor according to the first embodiment. In FIG. 2 and FIG. 8, which is described later, for the sake of simplicity, illustration of the coils 51 to 53 is omitted. The reactor 6 shown in FIG. 2 includes a core body 5 and an annular end plate 81 fastened to one end surface of the core body 5 in the axial direction. The end plate 81 functions as a connecting member connected to the outer peripheral iron core 20 of the core body 5 (described later) over the entire edge of the outer peripheral iron core 20. The end plate 81 is preferably formed from a non-magnetic material, such as aluminum, SUS, a resin, or the like.

Figure 3:
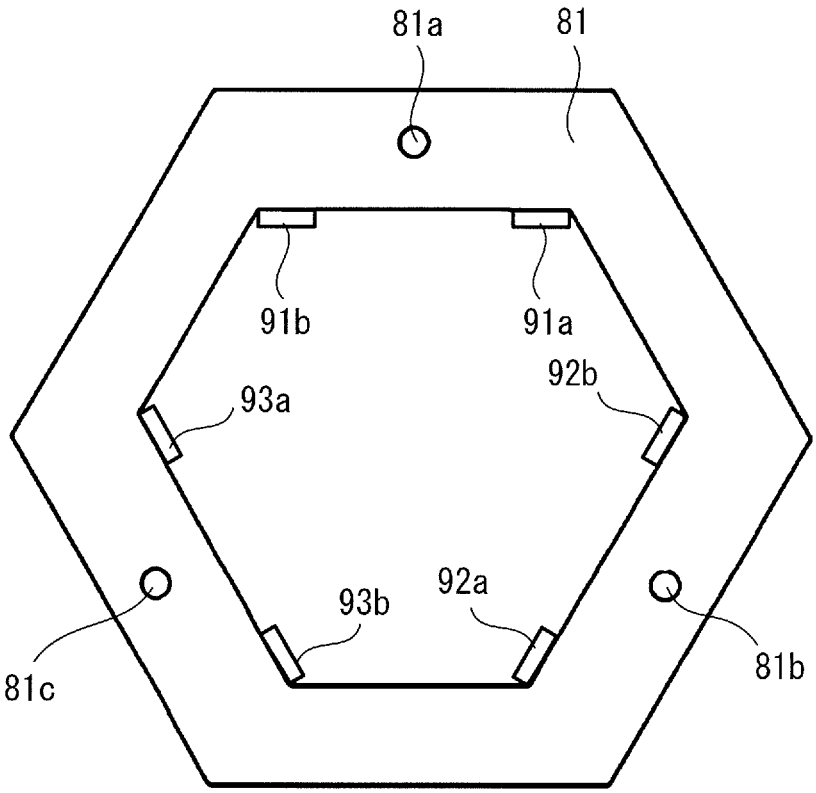
FIG. 3 is a top view of an end plate.

FIG. 3 is a top view of the end plate. As shown in FIG. 3, a plurality of fasteners, for example, six protrusions 91*a* to 93*b*, which protrude with respect to the end plate 81, are provided on the inner peripheral surface of the end plate 81. Note that other types of fasteners may be used.

Figure 4:
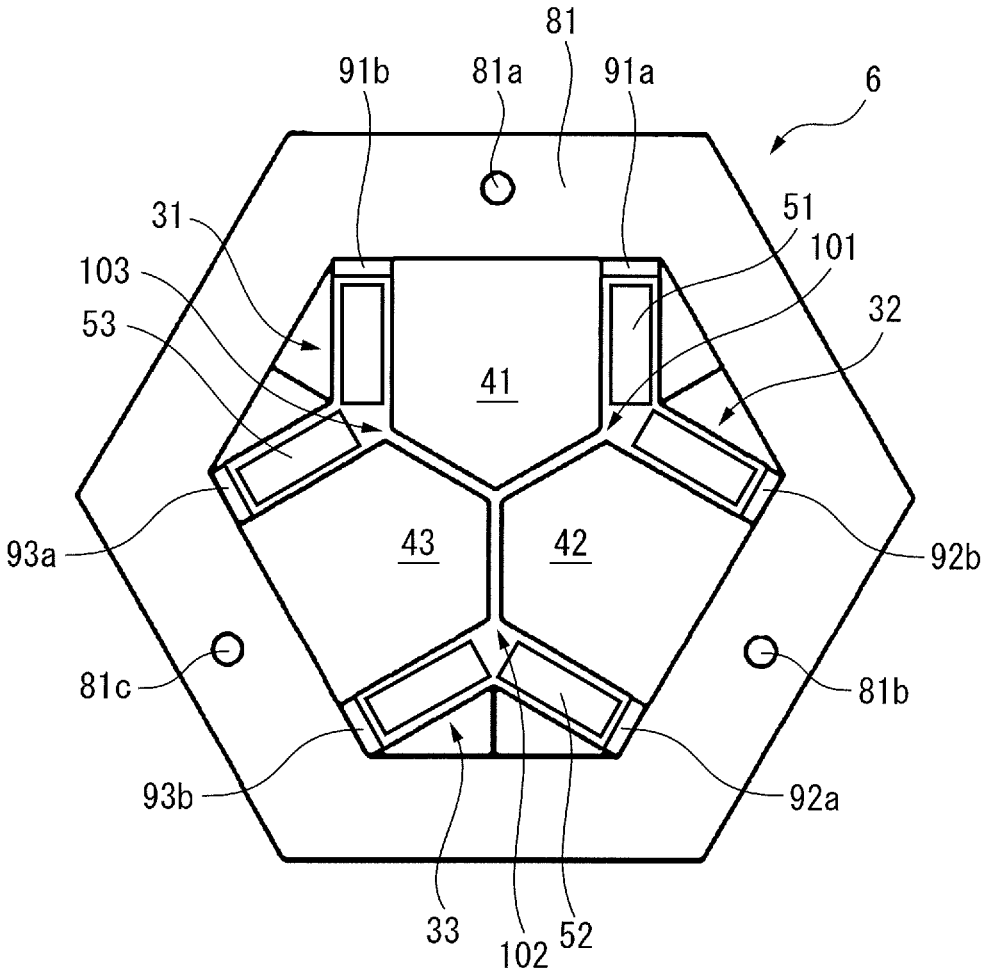
FIG. 4 is a top view of the reactor of the first embodiment.

Further, FIG. 4 is a top view of the reactor of the first embodiment. As can be understood with reference to FIG. 2 to FIG. 4, the protrusions 91*a* and 91*b* are formed at positions corresponding to opposite sides of the iron core 41. Similarly, the protrusions 92*a* and 92*b* and protrusions 93*a* and 93*b* are formed at positions corresponding to opposite sides of the iron cores 42 and 43, respectively.

Thus, when the end plate 81 is attached to the core body 5 as shown in FIG. 4, the protrusions 91*a* to 93*b* are arranged between the coils 51 to 53 and the inner peripheral surfaces of the outer peripheral iron core portions 24 to 26, respectively. The protrusions 91*a* to 93*b* contact the inner peripheral surfaces of the outer peripheral iron core portions 24 to 26.

As can be understood by comparing FIG. 1 and FIG. 4, the widths of the protrusions 91*a* to 93*b* are approximately equal to the widths of the coil spaces 51*a* to 53*a* in which the coils 51 to 53 are arranged. Thus, when the protrusions 91*a* to 93*b* contact the inner peripheral surfaces of the outer peripheral iron core portions 24 to 26, the protrusions 91*a* to 93*b* are interposed between the inner walls of the coil spaces 51*a* to 53*a*, and the protrusions 91*a* to 93*b* are fixed abutting against the radially outer ends of the coil spaces 51*a* to 53*a*. As a result, the outer peripheral iron core portions 24 to 26 can be fastened to each other. Thus, each of the circumferential ends of the adjacent outer peripheral iron core portions 24 to 26 abut each other so that the radially inner ends of the iron cores 41 to 43 are separated from each other via the gaps 101 to 103 having predetermined dimensions. In other words, the outer peripheral iron core portions 24 to 26 and the iron cores 41 to 43 are sized so that when the end plate 81 is attached and the protrusions 91*a* to 93*b* are inserted, gaps 101 to 103 of the desired dimensions are obtained. Therefore, the reactor 6 has the desired inductance. In this case, since special jigs are not required at the time of production of the reactor 6, it is possible to dramatically increase assembly efficiency.

As can be understood from FIG. 2 and FIG. 3, it is preferable that screws 99*a* to 99*c* as fasteners be passed through a plurality of through-holes 81*a* to 81*c* formed in the end plate 81 and screwed into holes 29*a* to 29*c* formed in advance in the outer peripheral iron core portions 24 to 26. As a result, the sizes of the gaps 101 to 103 can be maintained at the desired dimensions more accurately.

Figure 5A:
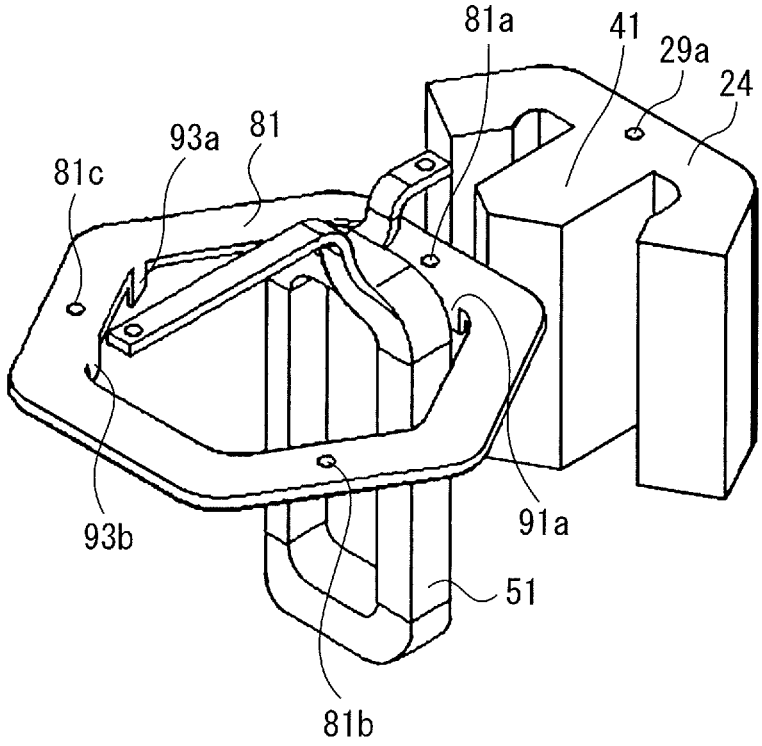
FIG. 5A is a first view detailing the manufacturing process of the reactor of the first embodiment.
Figure 5B:
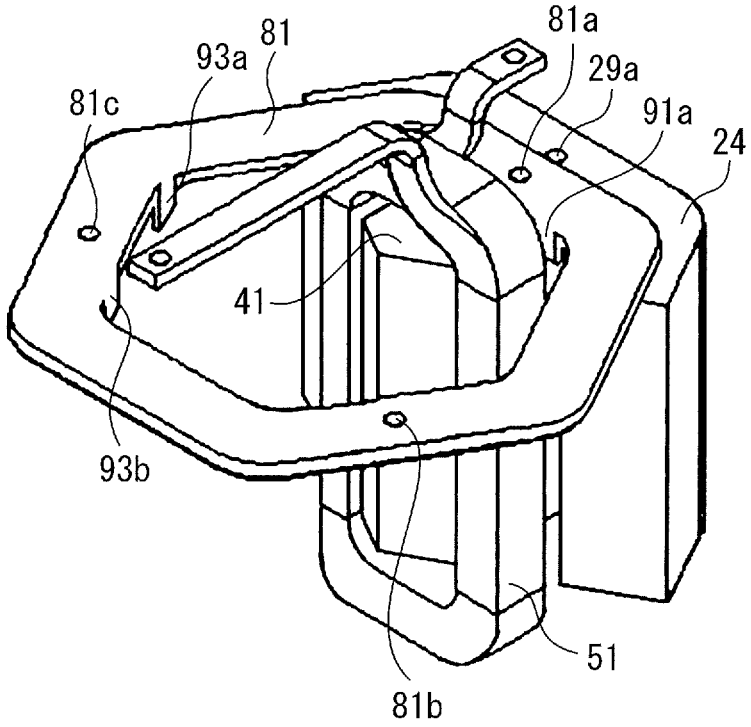
FIG. 5B is a second view detailing the manufacturing process of the reactor of the first embodiment.

Further, FIG. 5A and FIG. 5B are views detailing the manufacturing process of the reactor shown in FIG. 1. First, as can be seen in FIG. 5A, an end plate 81 having a plurality of fasteners, for example, six protrusions 91*a* to 93*b*, is prepared. The coil 51 is arranged at a position corresponding to the protrusions 91*a* and 91*b*. Then, the outer peripheral iron core portion 24 integrally connected to the iron core 41 is arranged on the outside of the end plate 81.

Then, as shown in FIG. 5B, the outer peripheral iron core portion 24 is moved so that the iron core 41 is inserted into the coil 51. As a result, the protrusions 91*a* and 91*b* (protrusion 91*b* is not shown in FIG. 5B) are brought into contact with the inner peripheral surface of the outer peripheral iron core portion 24 between the coil 51 and the outer peripheral iron core portion 24.

Though not shown in the drawings, the other coils 52 and 53 are arranged as described above at positions corresponding to the other protrusions 92*a* to 93*b*, respectively. The iron cores 42 and 43, which are integral with the outer peripheral iron core portions 25 and 26, are similarly inserted into the coils 52 and 53. Thus, the protrusions 91*a* to 93*b* abut against the radially outer ends of the coil spaces 51*a* to 53*a* as described above, and as a result, the outer peripheral iron core portions 24 to 26 are fastened to each other. In such a case, it is possible to automate the assembly of the reactor 6.

Thereafter, as described with reference to FIG. 2, the screws 99*a* to 99*c* as fasteners may be passed through the plurality of through-holes 81*a* to 81 of the end plate 81 and screwed into the holes 29*a* to 29*c* of the outer peripheral iron core portions 24 to 26. Note that, instead of arranging the coils 51 to 53 one by one, after the at least three coils 51 to 53 are arranged at the aforementioned positions, the iron cores 41 to 43 may be inserted into the coils 51 to 53 sequentially or simultaneously.

Figure 6:
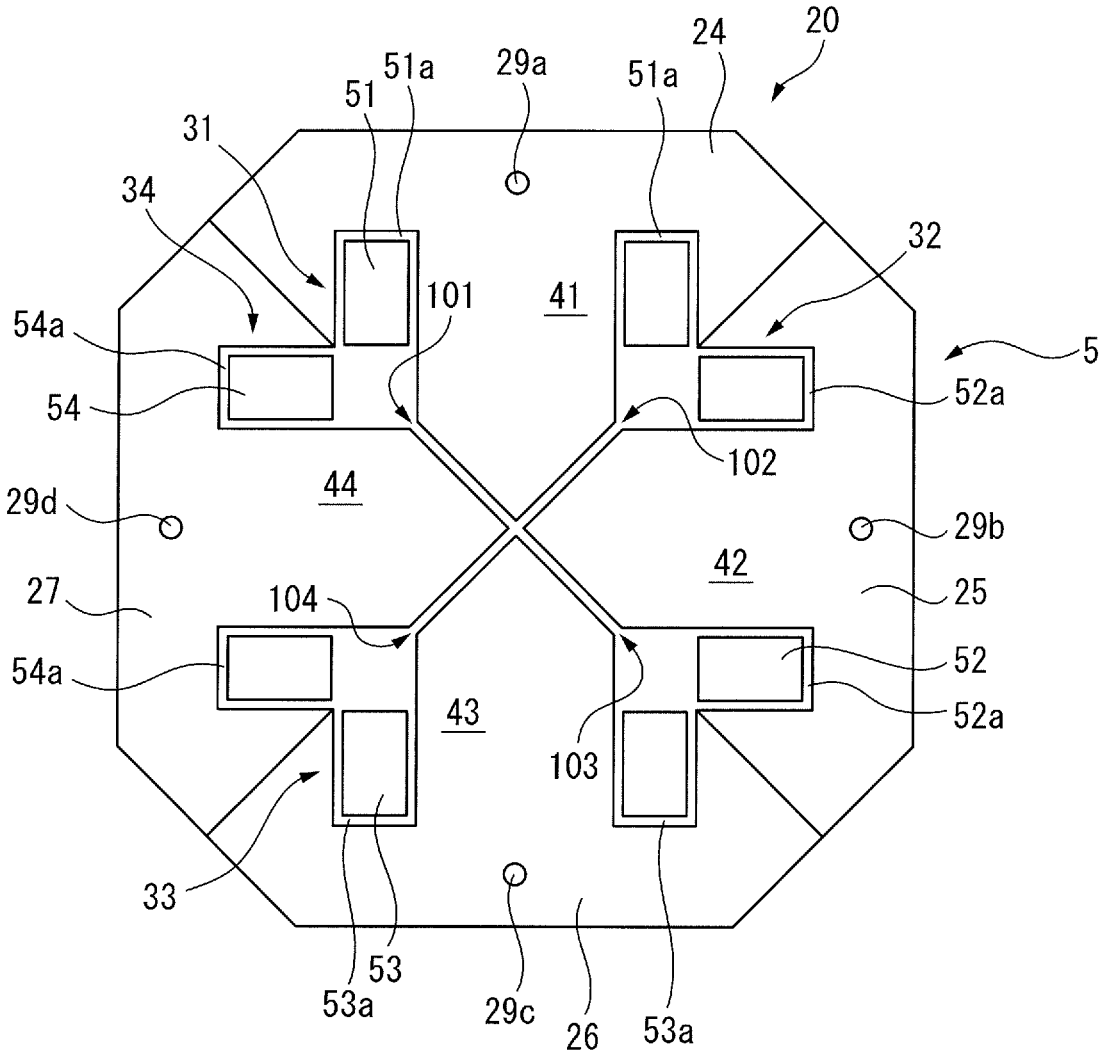
FIG. 6 is a cross-sectional view of a core body of a reactor of a second embodiment.

Note that the aforementioned end plate 81 may be fastened to a core body other than the core body 5 shown in FIG. 1. For example, FIG. 6 is a cross-sectional view of the core body of the reactor of a second embodiment. The core body 5 shown in FIG. 6 includes an approximately octagonally-shaped outer peripheral iron core 20 and four iron core coils 31 to 34 similar to those described above arranged inside the outer peripheral iron core 20. These iron core coils 31 to 34 are arranged at equal intervals in the circumferential direction of the core body 5. Furthermore, the number of iron cores is preferably an even number greater than or equal to four. As a result, the reactor including the core body 5 can be used as a single-phase reactor.

As can be understood from the drawing, the outer peripheral iron core 20 is composed of four outer peripheral iron core portions 24 to 27 divided in the circumferential direction. The iron core coils 31 to 34 include iron cores 41 to 44 extending in the radial direction and coils 51 to 54 wound around the corresponding iron cores. The respective radially outer ends of the iron cores 41 to 44 are integrally formed with the respective adjacent peripheral iron core portions 21 to 24. Note that the number of the iron cores 41 to 44 and the number of the outer peripheral iron core portions 24 to 27 need not necessarily match each other. The same is true for the core body 5 shown in FIG. 1.

Further, the radially inner ends of the iron cores 41 to 44 are located near the center of the outer peripheral iron core 20. In FIG. 6, the radially inner ends of the iron cores 41 to 44 converge toward the center of the outer peripheral iron core 20, and the tip angles thereof are about 90 degrees. The radially inner ends of the iron cores 41 to 44 are spaced from each other via the gaps 101 to 104, which can be magnetically coupled.

Figure 7:
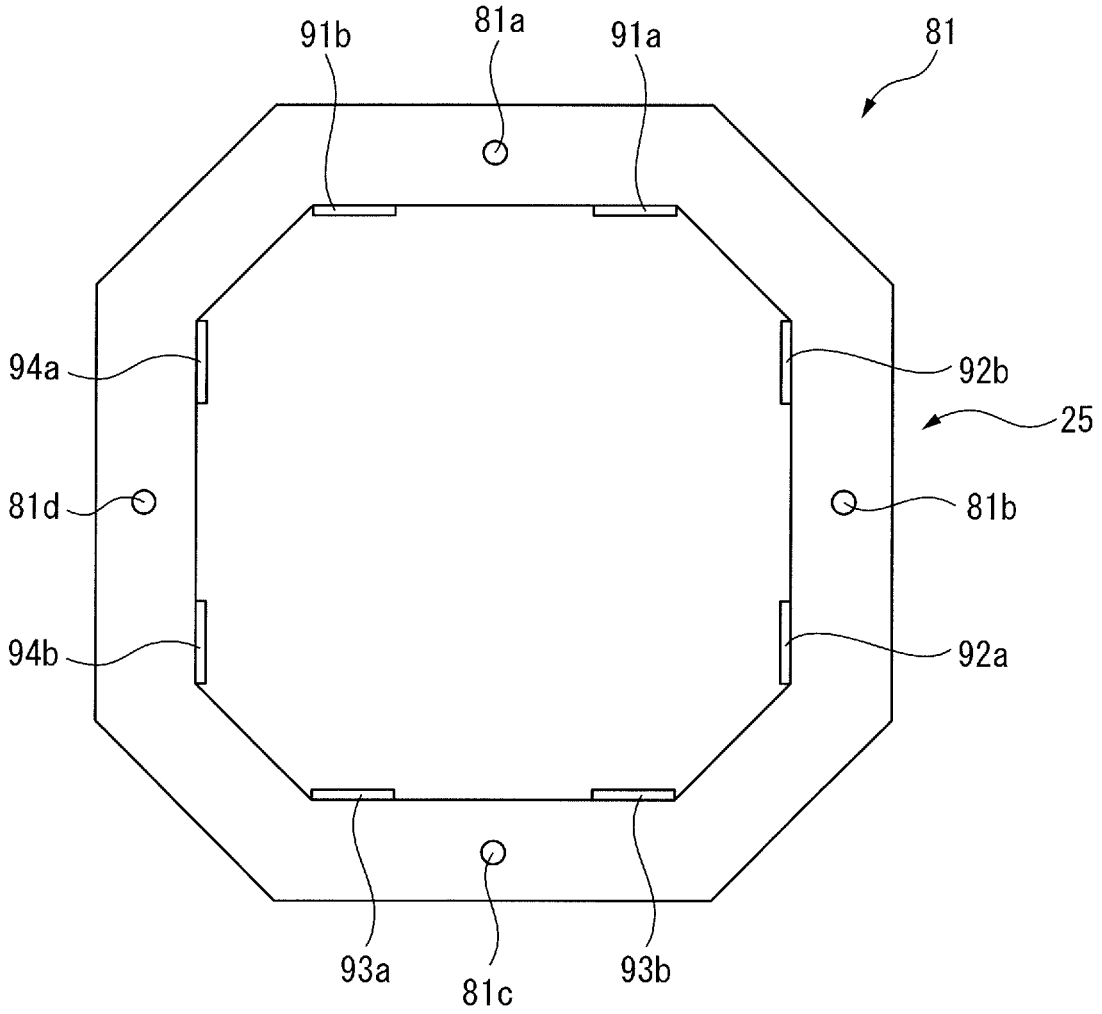
FIG. 7 is a top view of another end plate.

FIG. 7 is a top view of another end plate. The end plate 81 shown in FIG. 7 is approximately octagonally-shaped, and is provided with protrusions 91*a* to 94*b* similar to those described above. This end plate 81 is attached to the aforementioned core body 5 shown in FIG. 6 in the same manner as above. In such a case, it is obvious that the same effects as described above can be obtained.

Further, FIG. 8 is a perspective view of a reactor based on the third embodiment. In FIG. 8, the end plate 81 is attached to one end of the core body 5. Further, an end plate 82 which is configured similarly to the end plate 81 is attached to the other end of the core body 5. As a result, when the end plates 81 and 82 are attached to both ends of the core body 5, it can be understood that the outer peripheral iron core portions 24 to 26 can be more tightly fastened.

ASPECTS OF THE PRESENT DISCLOSURE

According to the first aspect, there is provided a reactor (6) comprising a core body (5), the core body comprising an outer peripheral iron core (20) composed of a plurality of outer peripheral iron core portions (24 to 27), at least three iron cores (41 to 44) coupled to the plurality of outer peripheral iron core portions, and coils (51 to 54) wound around the at least three iron cores; the reactor further comprising an end plate (81) fastened to at least one end of the core body; wherein the end plate includes a plurality of fasteners (91*a* to 94*b*, 99*a* to 99*d*) for fastening the plurality of outer peripheral iron core portions to each other.

According to the second aspect, in the first aspect, the plurality of fasteners include a plurality of protrusions which are inserted into regions between the coils and the plurality of outer peripheral iron core portions.

According to the third aspect, in the first or the second aspect, the end plate is formed from a non-magnetic material.

According to the fourth aspect, in any of the first through the third aspect, the number of the at least three iron cores is a multiple of three.

According to the fifth aspect, in any of the first through the third aspect, the number of the at least three iron cores is an even number not less than 4.

According to the sixth aspect, in any of the first through the fifth aspect, when the plurality of fasteners fasten the plurality of outer peripheral iron core portions, the radially inner ends of the iron cores are spaced from each other via gaps (101 to 104) of predetermined dimensions.

According to the seventh aspect, there is provided a method for the production of a reactor (6), comprising the steps of preparing an end plate (81) including a plurality of fasteners (91*a* to 94*b*, 99*a* to 99*d*); arranging at least three coils (51 to 54) at positions corresponding to the plurality of fasteners; preparing at least three iron cores (41 to 44) coupled to a plurality of outer peripheral iron core portions (24 to 27) which constitute an outer peripheral iron core (20); inserting the at least three iron cores into the respective at least three coils; and fastening the plurality of outer peripheral iron core portions to each other with the plurality of fasteners.

Effects of the Aspects

In the first aspect, since the plurality of fasteners fasten the plurality of outer peripheral iron core portions to each other, the gaps formed between two adjacent iron cores from among the at least three iron cores can easily be maintained at a desired size. Further, special jigs are not required at the time of production, and assembly efficiency can be dramatically increased.

In the second aspect, a plurality of protrusions are arranged in the areas between the coils and the plurality of outer peripheral iron core portions to fasten the outer peripheral iron core portions.

In the third aspect, the non-magnetic material is preferably, for example, aluminum, SUS, a resin, or the like, and as a result, it is possible to prevent the magnetic field passing through the end plate.

In the fourth aspect, the reactor can be used as a three-phase reactor.

In the fifth aspect, the reactor can be used as a single-phase reactor.

In the sixth aspect, gaps of desired dimensions can be easily formed.

In the seventh aspect, since the plurality of fasteners fasten the plurality of the adjacent outer peripheral iron core portions to each other, the gaps formed between two adjacent iron cores from among the at least three iron cores can easily be maintained at a desired dimension. Further, special jigs are not required at the time of manufacture, whereby assembly efficiency can be dramatically increased. In addition, the reactor can be automatically manufactured.

Though the present invention has been described using representative embodiments, a person skilled in the art would understand that the foregoing modifications and various other modifications, omissions, and additions could be made without departing from the scope of the present disclosure.

The invention claimed is:

1. A reactor, comprising:

a core body, the core body comprising: an outer peripheral iron core composed of a plurality of outer peripheral iron core portions, at least three iron cores each integrally formed with a corresponding one of the plurality of outer peripheral iron core portions, and coils wound around the at least three iron cores, the respective radially inner ends of the at least three iron cores being located in the vicinity of a center of the outer peripheral iron core and converging toward the center of the outer peripheral iron core, and the radially inner ends of the at least three iron cores being spaced from each other via gaps, which can be magnetically coupled; the reactor further comprising: an annular end plate fastened to at least one end of the core body; wherein the end plate has a shape corresponding to a shape of the outer peripheral iron core, and includes a plurality of fasteners for fastening the plurality of outer peripheral iron core portions to each other, wherein the plurality of fasteners include a plurality of protrusions which are inserted into regions between the coils and the plurality of outer peripheral iron core portions.

2. The reactor according to claim 1, wherein the end plate is formed from a non-magnetic material.

3. The reactor according to claim 1, wherein the number of the at least three iron cores is a multiple of three.

4. The reactor according to claim 1, wherein the number of the at least three iron cores is an even number not less than 4.

5. The reactor according to claim 1, wherein when the plurality of fasteners fasten the plurality of outer peripheral iron core portions, the radially inner ends of the iron cores are spaced from each other via gaps of predetermined dimensions.

6. A reactor, comprising:

a core body, the core body comprising:

an outer peripheral iron core composed of a plurality of outer peripheral iron core portions, at least three iron cores coupled to the plurality of outer peripheral iron core portions, and coils wound around the at least three iron cores, the respective radially inner ends of the at least three iron cores being located in the vicinity of a center of the outer peripheral iron core and converging toward the center of the outer peripheral iron core, and the radially inner ends of the at least three iron cores being spaced from each other via gaps, which can be magnetically coupled;

the reactor further comprising:

an end plate fastened to at least one end of the core body; wherein the end plate includes a plurality of fasteners for fastening the plurality of outer peripheral iron core portions to each other;

the plurality of fasteners include a plurality of protrusions which are inserted into regions between the coils and the plurality of outer peripheral iron core portions;

the plurality of protrusions protrude from the end plate and are formed in positions corresponding to the sides of the iron core; and when the end plate is assembled with the core body, the plurality of protrusions are located between the at least three coils and inner peripheral surfaces of the plurality of outer peripheral iron core portions, and contact the inner peripheral surfaces of the plurality of outer peripheral iron core portions.

7. A reactor, comprising:

a core body, the core body comprising:

an outer peripheral iron core composed of a plurality of outer peripheral iron core portions, at least three iron cores coupled to the plurality of outer peripheral iron core portions, and coils wound around the at least three iron cores, the respective radially inner ends of the at least three iron cores being located in the vicinity of a center of the outer peripheral iron core and converging toward the center of the outer peripheral iron core, and the radially inner ends of the at least three iron cores being spaced from each other via gaps, which can be magnetically coupled;

the reactor further comprising:

an annular end plate assembled with at least one end of the core body; wherein the end plate has a shape corresponding to a shape of the outer peripheral iron core, and includes a plurality of fasteners for fastening the plurality of outer peripheral iron core portions to each other; and when the plurality of fasteners fasten the plurality of outer peripheral iron core portions, the radially inner ends of the iron cores are spaced from each other via gaps of predetermined dimensions, wherein the plurality of fasteners include a plurality of protrusions which are inserted into regions between the coils and the plurality of outer peripheral iron core portions.

* * * * *